United States Patent [19]

Amalaha

[11] Patent Number: 4,989,254

[45] Date of Patent: Jan. 29, 1991

[54] ELECTRO-ACOUSTIC TRANSDUCER AND MANUFACTURING PROCESS

[76] Inventor: Leonard D. Amalaha, 6202 44th Ave., Riverdale, Md. 20737

[21] Appl. No.: 373,258

[22] Filed: Jun. 30, 1989

[51] Int. Cl.[5] ..... H04R 7/00

[52] U.S. Cl. ..... 381/202; 381/188; 381/192

[58] Field of Search ..... 381/202, 188, 156, 158, 381/160, 192; 181/155, 152

[56] References Cited

U.S. PATENT DOCUMENTS

| | | | |
|---|---|---|---|
| 3,385,929 | 5/1968 | Magyar et al. | 181/145 |
| 3,500,953 | 3/1970 | Lahti | 181/152 |
| 3,976,838 | 8/1976 | Stallings, Jr. | 181/153 |
| 4,665,550 | 5/1987 | Haas | 381/188 |

*Primary Examiner*—Jin F. Ng
*Assistant Examiner*—M. Nelson McGeary, III.
*Attorney, Agent, or Firm*—Richard C. Litman

[57] ABSTRACT

An electro-acoustic transducer having a spherically shaped diaphragm for the generation of sound in an omnidirectional capacity. The spherically shaped diaphragm is constituted of two identical diaphragm halves open at the hemispherical apexes and connected at the equatorial diameter via inwardly extending reinforcing flanges. The spherically shaped unit is driven by magnetic arrangement(s) located within the interior of the spherically shaped diaphragm. The moving coil(s) of the magnetic arrangement(s) are connected to the diaphragm via rigid conical projections from the magnetic arangement(s). The rigid conical projections communicate the movements of the coil(s) to the diaphragm. The diaphragm travels in a north-south direction during operation such that the sound generated will have omnidirectional characteristics with greater pressure in the north-south direction. A wave-guide shaped base plate channels some of the waves from the north-south direction to the east-west direction to increase omnidirectional dispersion of sound. The manufacturing process renders easy assembly of the components of the transducer.

7 Claims, 6 Drawing Sheets

ELECTRO-ACOUSTIC TRANSDUCER AND MANUFACTURING PROCESS

BACKGROUND OF THE INVENTION

1. FIELD OF THE INVENTION

The present invention relates to an electro-acoustic transducer for reproducing sound in either the low, medium, or high frequencies in concert halls, sound studios, home, automobile, and the like in predominantly a non-directional pattern due to the spherical shape of the radiating diaphragm.

2. DESCRIPTION OF THE PRIOR ART

Several known electro-acoustic transducers embody a diaphragm with a spherical shape. However, either owing to a method of obtaining the spherical shape and/or the operating principle for driving the diaphragm, none have achieved acceptable omnidirectional dispersion of the radiated waves, contrary to repeated affirmation of such in numerous claims. U.S. Pat. No. 1,690,726 issued to E. F. Hollinger on Nov. 6, 1928 discloses a loudspeaker having an ovoidially shaped diaphragm driven in a north-south axial direction by an exteriorly located magnetic arrangement. The magnetic unit is comprised of a permanent magnet and an electromagnet which drive the lower segment of the diaphragm. The ovoid diaphragm is comprised of an upper dome shaped diaphragm and a lower cone shaped diaphragm. Each of the diaphragm portions is in itself composed of vertically disposed strip-like segments. The lower section of the diaphragm is connected to a vibrating armature while the upper section of the diaphragm is retained by a rod running from the top of the diaphragm through the armature means to the actuating means. A means that is flexible is used to connect the two halves of the diaphragm together. The operating principle of the loudspeaker requires the upper half remain relatively rigid. The upper half of the diaphragm serves as a wave guide while the lower half acts as the resonant member.

It is quite apparent that unlike the perfect sphere of the present invention which is driven by internally located magnetic arrangement(s), the Hollinger '726 ovoid diaphragm does not achieve acceptable omidirectionality. All sections of the Hollinger '726 diaphragm do not participate in the reproduction of sound. In fact, the presence of an outwardly extending yeildable member connecting the two halves of the diaphragm together prevents air from wrapping around the pear shaped diaphragm during minute movements.

In U.S. Pat. No. 1,653,045 issued to E. F. Hollinger on Dec. 20, 1927, Hollinger teaches a loudspeaker embodying a configuration very similar to Hollinger '726. However, in this later patent, Hollinger incorporates a diaphragm that is a unitary sphere driven in its entirety at its lower end by an actuating means. It is very apparent that the relatively massive sphere of the Hollinger '045 design could not be effectively driven at its lower edge by the actuating means. Nor could the Hollinger '045 speaker produce a true reproduction of sound in an honest omnidirectional capacity.

Yet another of Hollinger's loudspeakers is disclosed by U.S. Pat. No. 1,690,725 issued on Nov. 6, 1928. the Hollinger '725 patent follows the configuration of his '726 loudspeaker. However, the '725 loudspeaker is largely spherical, and the halves are connected by the same yeildable member at the equatorial diameter. The shortcomings of the '726 design are as easily apparent in the '725 version. As a result, it is not necessary to delve into a discourse on the Hollinger '725 shortcomings.

U.S. Pat. No. 1,776,223 issued to J. V. L. Hogan on Sept. 16, 1930 discloses a loudspeaker employing a spherical diaphragm. Due to the means for rigidly securing the radiating diaphragm to a rigid part of the system, and also due to the driving mechanism of the spherical diaphragm via an exteriorly located unit, the diaphragm does not have the freedom of motion to accurately reproduce the motions imparted by the actuating unit. As a result, the loudspeaker can not reproduce sound in a truly omnidirectional capacity. Also, due to the design of this speaker, and the others aforementioned, it can not be reduced in size because of the exteriorly located actuating means. To reiterate, the Hogan and the Hollinger speakers fail to provide good reproducible sound. Moreover, they can not achieve omnidirectional dispersion of sound waves.

U.S. Pat. No. 4,472,605 issued to S. Klein on Sept. 18, 1984 is still another spherical loudspeaker disclosed by the prior art. In the Klein loudspeaker, two hemispherical diaphragms are arranged on either side of a disk shaped carrier part. The diaphragms are connected to these disks by flanges. The connection of these parts results in the formation of a chamber. A magnetic arrangement drives each of the hemispheres via a rigid hemispherical projection attached to the hemispherical diaphragms. The peripheral edge sections of the diaphragms are retained by a yeildable surround exteriorly located and attached to exterior projections of the disc shaped carrier parts. The actuating units are interiorly located.

The Klein loudspeaker does not present a true sphere because the diaphragm halves are not directly connected either flexibly or rigidly. The resultant shape of the diaphragm is an oblate spheroid due to the presence of the peripheral yeildable surrounds, carrier parts, and carrier spacer. The loudspeaker is, indeed, a pair of electrically connected dipoles. The aerodynamics of the resultant shape prevents air from effectively passing through the equator defined by the carrier part. During high acoustic output when the air manages to travel past both the carrier part and the yeildable surround, the net force in the equatorial direction is reduced to a minimum so that acceptable omnidirectional sound dispersion is not achieved. Omnidirectionality is not achieved, because the two diaphragm halves vibrate in opposite directions at right angles to the carrier parts. This creates stationary waves (a combination of two waves of the same strength and frequency traveling in opposite directions) at the equatorial diameter which reduces the acoustic output thereabout. Tests on such loudspeakers as the Klein design have proven this finding to be correct. It has been observed that the relatively large hemispherical projections driving the diaphragms substantially increases the overall weight of the moving members and reduces the sensitivity of the entire system.

U.S. Pat. No. 4,550,797 issued to Suzuki on Nov. 5, 1985 presents a dome shaped loudspeaker diaphragm having a molded sintered ceramic body having an outwardly extending peripheral flange. This prior invention must not be confused with the open apex hemispheres comprising the spherically shaped diaphragm of the present invention. The present invention further differs from the Suzuki diaphragm design in that the peripheral edge flanges are inwardly extending. The inwardly extending edge flange permits spherical alignment at the equatorial diameter.

U.S. Pat. No. 2,846,520 issued to P. J. Brownscombe on Aug. 5, 1958 presents a loudspeaker having magnetic arrangements housed behind a dome shaped diaphragm. Brownscombe utilizes the dome shaped diaphragm to increase the angle of dispersion of sound. Brownscombe discloses in U.S. Pat. No. 2,846,520 some modifications of his earlier designs. This Brownscombe design, in addition to his prior concepts, differ completely from the present invention both in function and assemblage.

SUMMARY OF THE INVENTION

Accordingly, it is an object of the present invention to provide an electro-acoustic transducer having a spherically shaped diaphragm driven as a single unit in an axial north-south direction by interiorly located magnetic arrangement(s). The diaphragm can also be a prolate or oblate spheroid connected to the magnetic arrangement(s) of the present invention.

It is another object of the present invention to provide an electro-acoustic transducer having a spherically shaped diaphragm in which the radiated waves are non-directional in nature due in part to a wave-guide-shaped base plate which channels some south-bound waves to the equatorial east-west direction.

It is yet another object of the present invention to furnish an electro-acoustic transducer in which the size of the drive cones can be reduced due to the close proximity of the magnetic arrangement(s) within the volume defined by the diaphragm halves.

It is still another object of the present invention to provide a location within the sphere of a flexible wall or surround which is movably attached to the sphere's equator as well as to a rigid part of the system, thereby extending its lifespan due to reduced exposure to the elements.

It is another object of the present invention to attach a spider suspension means to both the lower open end edge of the spherical diaphragm and a rigid part of the modified transducer.

Still another aspect of the present invention is the provision of a method of easily and accurately assembling the embodiments.

Finally, it is an object of the present invention to furnish an electro-acoustic transducer with a very high acoustic output for the known audible frequency range.

With these and other objects in view which will more readily appear as the nature of the invention is better understood, the invention resides in the novel combination and arrangement of parts hereinafter more fully described and illustrated, with reference being made to the accompanying drawings.

BRIEF DESCRIPTION OF THE DRAWINGS

Similar reference characters designate corresponding parts throughout the various figures of the drawings.

DESCRIPTION OF THE PREFERRED EMBODIMENT

Figure 12:
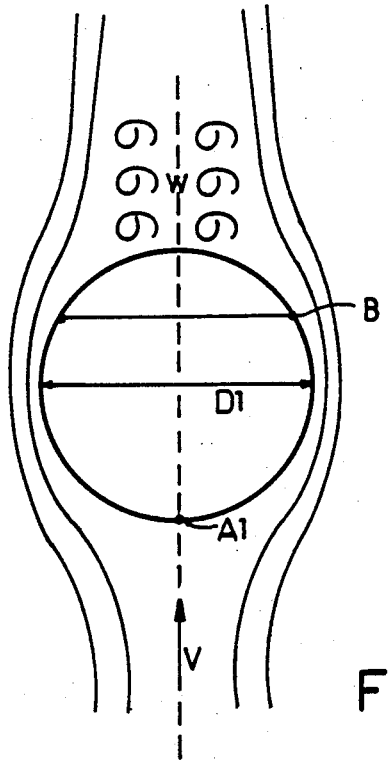
FIG. 12 is a diagram used to explain pictorially the physical relationship between a spherical body wholly immersed in a fluid and moving with steady motion within that fluid.

In fluid mechanics, Daniel Bernoulli's theorem expresses the conservation of mechanical energy in an ideal (frictionless, nonviscous) and incompressible fluid in steady motion. FIG. 12 shows the relationship hereinafter described pictorially. Mechanical energy reveals itself as kinetic energy, pressure energy, or potential energy. These forms of energy are interchangeable and their numerical sum must remain constant. In relation to Bernoulli's law, a spherical body wholly immersed in a fluid such as air experiences dynamic forces from the fluid on its surface as it moves with steady motion through the fluid. In this physical reality, there may be a force in the direction of the fluid motion called a drag, or a force perpendicular to the direction of the fluid motion called a lift. Drag is expressed by the following equation:

$$D=\tfrac{1}{2}*P*V^2*A*C_D$$

where:

P=Density
V=Velocity
A=The projected area of the body
$C_D$=The coefficient of drag
$A_1$=The point of stagnation
B=The point of separation
$D_1$=The diameter of the sphere
W=The wake As the fluid flows around the sphere, the velocity will change in the vicinity of the surface, and it will come to a halt at the stagnation point $A_1$. Ultimate velocity of the fluid will be achieved at the sphere's diameter $D_1$. There will be additional pressure build-up at the stagnation point $A_1$ which is also equal to the dynamic pressure. As a result of the formation of eddies in the wake, the pressure will be greater in front of the sphere than on the downward stream. The components of the fluid acting on the sphere would reverse their direction and points of action on the sphere if its direction of motion within the fluid were reversed. There would be a negligible drag on the sphere in a non-viscous fluid. There is a useful drag when the fluid is air such as in the situation of the electro-acoustic transducer of the present invention. With an ideal fluid, velocity and pressure distribution would be the same both in front of and in the rear of the sphere, and a stagnation point would be located in the back center. From the above understanding, it is quite apparent that for a spherically shaped diaphragm for a loudspeaker to achieve a measured degree of omnidirectionality during the course of its operation, the entire sphere must move as a unit. In other words, if the aforementioned sphere is composed of two separate hemispheres as in the case of the present invention, both halves should be directly, movably linked.

Figure 1:
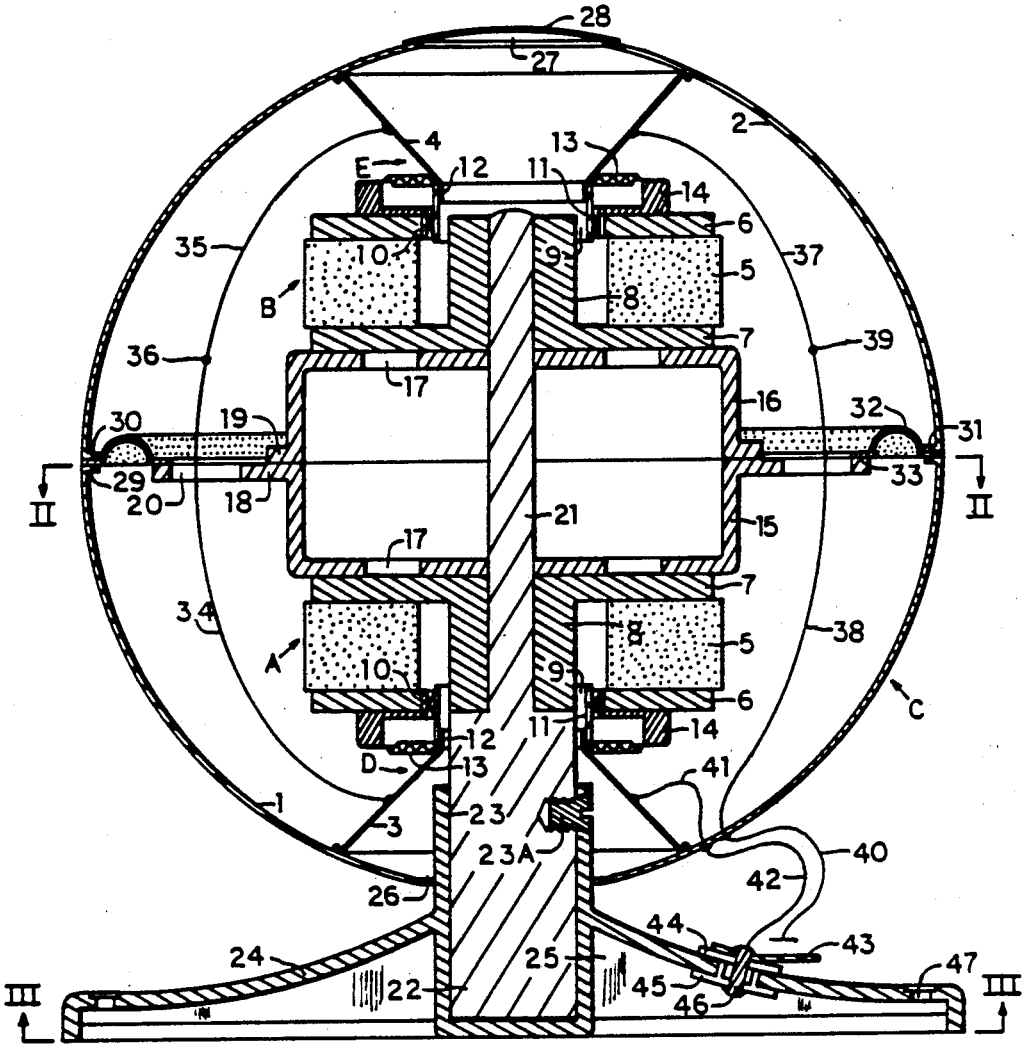
FIG. 1 is a cross-sectional illustration of the electro-acoustic transducer of the present invention.

An electro-acoustic transducer constructed according to the teachings of the present invention and depicted in FIG. 1 has two magnetic arrangements A and B to drive a ball-shaped diaphragm C. the diaphragm C is constructed of two identical hemispherical portions 1 and 2. Identical conical projections 3 and 4 are attached by means of a bonding agent to the apex regions of the hemispheres 1 and 2. The conical projections 3 and 4 have necks 3*a* and 4*a* for attaching, by means of a bonding agent, the voice coil bobbins 11 and 12 respectively. At the point of termination of the necks 3*a* and 4*a* of the conical projections 3 and 4, there are connected, by means of a bonding agent, spider suspensions 13. Edge wound voice coils 10 on the bobbins 11 and 12 sit in annular air gaps 9 of the aforementioned magnetic arrangements A and B. The annular air gaps 9 are formed both by outer pole pieces 6 and stubs 8 of inner pole pieces 7. The pole pieces 6 and 7 for the respective magnetic arrangements A and B are applied on either side of the ring shaped magnets 5. Both magnetic arrangements A and B are of conventional configurations. Connected to the outer pole pieces 6 of the respective magnetic arrangements A and B are annular posts 14 onto which the outer edges of the spider suspensions 13 are bonded to permit the voice coils 10 to move in the air gaps 9. The posts 14 are recessed such that the edge of the central openings align with those of the pole pieces 6 for the proper attachment of the spider suspensions 13.

The magnetic arrangements A and B are respectively cemented to cup shaped carrier parts 15 and 16 such that the lower magnetic arrangement A is inverted while the upper magnetic arrangement B stands upright. The carrier parts 15 and 16 are connected by edge flanges 18 and 19 and bonded at these edge flanges 18 and 19. The flange 18 of the lower carrier part 15 extends close enough to the equator of the ball shaped diaphragm C such that the inner edge of the flange 33 of the flexible surround 32 is attached to it by means of a bonding agent. The outer edge flange 31 of the flexible surround 32 is sandwiched between the peripheral edge flanges 29 and 30 of the respective hemispherical portions 1 and 2 of the diaphragm C and bonded to both to restore the diaphragm C at the equatorial region. The peripheral edge flanges 29 and 30 extend inwardly such that the air flow around the sphere C is completely unobstructed during operation. The hemispheres 1 and 2 have respective open apexes 26 and 27 to enable air to reach and cool the coils 10 for increased power handling. The upper diaphragm opening 27 is covered by an air permeable dust cap 28 attached by a bonding agent to the apex region of the hemisphere 2. The diaphragm C is preferably made of fiber reinforced plastics or varnish bonded fabrics.

The entire weight of the magnetic arrangements A and B and the diaphragm C is supported by a rounded support pole 22 having a centrally located stalk-like connecting rod 21. The connecting rod 21 of the support pole 22 has a diameter which matches and mates with the diameter of the centrally located openings on the stubs 8 of the inner magnetic pole pieces 7 and the carrier parts 15 and 16. The connecting rod 21 runs the length of the stubs 8 by passing through the chamber created by the carrier parts 15 and 16 and is rigidly bonded to the aforementioned embodiments. A light metal with high tensile strength such as aluminum is preferred for the support pole 22. For the purpose of alignment, the support pole 22 has a diameter equal to that of the stubs 8 of the respective magnetic arrangements A and B. The presence of the edge flange 18 of the lower carrier part 15 divides the interior of the spherical diaphragm C into two acoustic chambers. Air movement between the acoustic chambers is accomplished via the openings 20. Much like the openings 17 on the carrier parts 15 and 16, the opening 20 helps to reduce the weight of the embodiments. The carrier parts 15 and 16 project their respective magnetic arrangements A and B closer to the respective hemispherical diaphragm halves 1 and 2. The reduced distance between the magnetic arrangements A and B and the hemispheres 1 and 2 enables the length and/or size of the drive cones 3 and 4 to be kept to a minimum so that the increased sensitivity arising from the reduced weight of the movable members is achieved. The drive cones 3 and 4 are preferably composed of a strong but light material such as aluminum foil, plastics or treated paper.

For the purpose of preventing the non-movable components of the system from resonating during operation, the support pole 22 is to be rigidly secured by cementing and/or a locking screw 23*a* to a centrally located tubular projection part 23 of a wave guide shaped base plate 24. The tubular projection 23 protrudes into the lower hemisphere 1 but has a safe clearance between it and the lower drive cone 3. The tubular projection 23 has an internal diameter which matches and mates with the diameter of the support pole 22 and an external diameter less than that of the opening 26 of the lower diaphragm hemisphere 1. The base plate 24 and the carrier parts 15 and 16 are made preferably of alloys of high tensile strength and lightness such as aluminum or steel. The diaphragm C has a safe distance from the base plate 24 which is reinforced by flanges 25 connecting it at the lower edge of the tube 23.

Electrical current to and from the voice coils 10 is carried by soft, minute gauge, rubber insulated conductors 34, 35, 37, 38, and 41. The internal conductors 34, 35 and 37, 38 are respectively joined together at points 36 and 39. External conductors 40 and 42 are of the naked type and are connected to the internal conductors via openings on the lower half of the diaphragm C. The external conductors 40 and 42 are connected as well to terminals 43 secured atop non-conducting circular plates 44 and 45 held to the base plate 24 by means of rivets 46. The operating principle of the electro-acoustic transducer of the present invention entails that the diaphragm C must move away from the base plate 24 during operation and come to rest directly above the base plate 24 at the position shown in FIG. 1. This means that while the lower voice coil 10 is moving into its air gap 9, the upper voice coil 10 is moving out of its air gap 9 thereby aiding the motion of the ball shaped diaphragm C. To achieve this coordination of voice coils 10, the lower voice coil 10 is wound clockwise, on its bobbin 11, the upper coil 10 is wound counterclockwise, and both are connected in series. Both coils 10 could be wound clockwise on the bobbins 11 and the internal conductors 35 and 37 could be switched around to reverse the current direction and achieve this operating principle. Also, through careful observation of the polarity, each of the magnets 5 could be used to determine the direction of motion of the coils 10. For the purpose of mounting the loudspeaker, holes 47 are provided on the base plate 24. The speaker can be mounted atop a disk connected to the upper edge of an adjustment stand.

Figure 2:
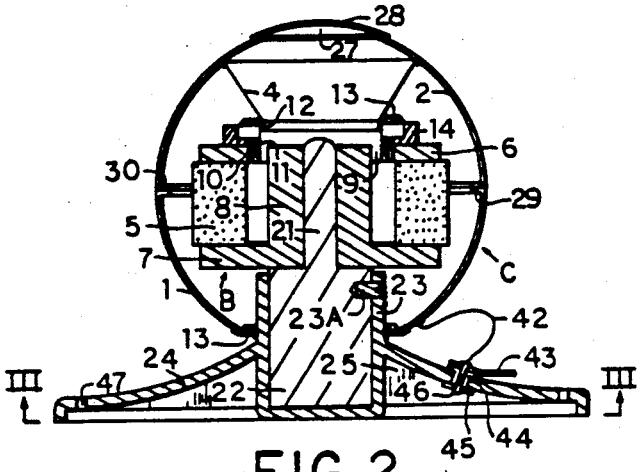
FIG. 2 is a cross-sectional view of a modification of the electro-acoustic transducer shown in FIG. 1.

FIG. 2 is a cross-sectional view of a modification of the electro-acoustic transducer shown in FIG. 1. While the modification depicted in FIG. 2 renders the transducer capable of reproducing the high and/or upper mid-range frequencies, the original configuration shown in FIG. 1 is most suitable for reproducing the low and mid-range frequencies. The differences between what is shown in FIG. 1 and FIG. 2 are the absence of a second magnetic arrangement A, a flexible surround 32 owing to very small diaphragm C movements, the attachment of a second spider suspension 13 to both the tubular projection 23 and the lower open edge of the diaphragm C, and the absence of the magnet carrier parts 15 and 16. Similar to the embodiment shown in FIG. 1, B is the magnetic arrangement which drives the ball shaped diaphragm C. By means of a bonding agent, the conical projection 4 is attached to the apex region of the upper hemisphere 2. The conical projection 4 has a neck 4*a* onto which a coil bobbin 11 is attached by bonding. A spider suspension 13 is attached to the neck 4*a* at the point of termination of the cone 4 by means of a bonding agent. The voice coil 10 sits in the air gap 9 of the magnetic arrangement B. The air gap 9 is formed by both the outer pole piece 6 and the stub 8 of the inner pole piece 7. The pole pieces 6 and 7 are applied on either side of the magnet 5 as in conventional practice. Cemented to the outer pole piece 6 of the magnetic arrangement B is an annular post 14 onto which the outer edge of the spider suspension 13 is bonded to permit minimum resistance to axial motion by the voice coil 10 in air gap 9.

The post 14 is recessed such that the edge of the central opening aligns with that of the outer pole piece 6 for the proper attachment of the spider suspension 13. The hemispheres 1 and 2 constituting the spherical diaphragm C have inwardly extending peripheral edge flanges 29 and 30 bonded together at the equator. The diaphragm C has an upper open apex 27 covered by an air permeable dust cap 28 attached to the apex region of the hemisphere 2 by a bonding agent. Soft metal alloys or fiber reinforced plastic materials are preferred in the manufacture of the diaphragm C. The weight of the magnetic arrangements B and the diaphragm C is supported by the pole 22 which has a central connecting rod 21. The support pole 22 could be hollow depending upon the strength of the material. The connecting rod 21 of the support pole 22 has a diameter which matches and mates with the diameter of a centrally located opening on the stub 8 of the inner pole piece 7 by running the length of the stub 8. A strong but light material such as aluminum is preferred for support pole 22. Due to the relatively small size and movement of the diaphragm C, the magnetic arrangement B occupies a greater part of the interior. Aluminum foil is preferred for the drive cone 4. However, other materials can be successfully employed.

Figure 3:
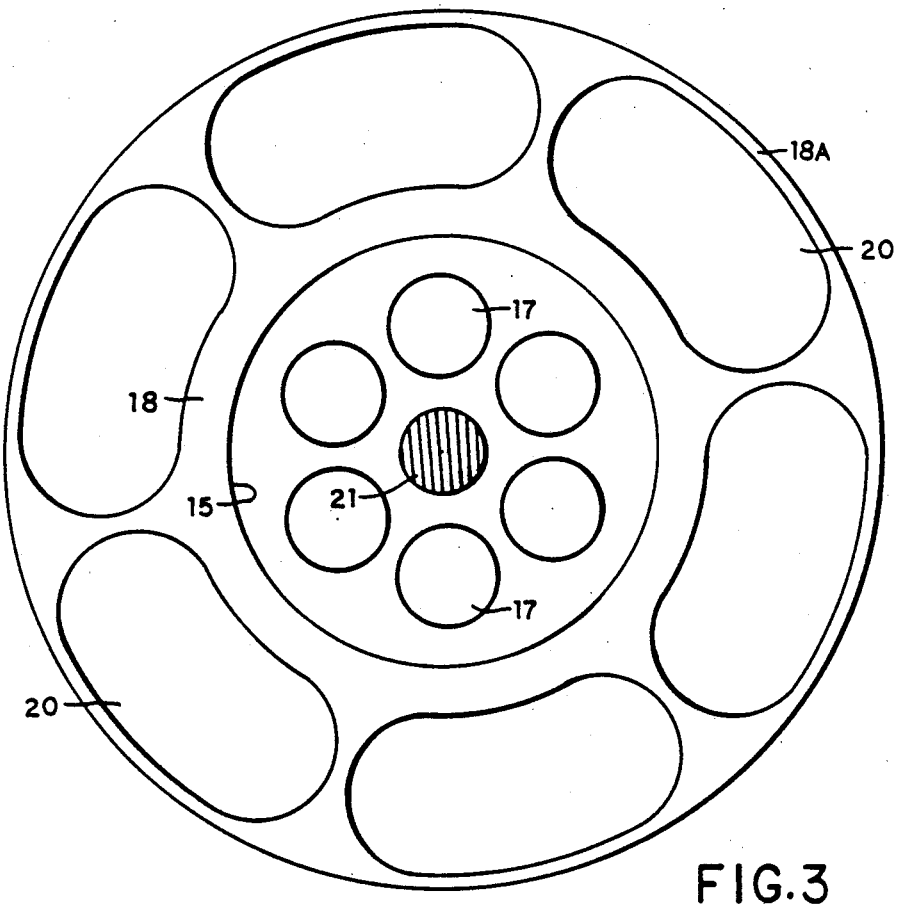
FIG. 3 is a sectional view taken along line II—II of FIG. 1.

For the purpose of preventing the non-movable members of the system from resonating, the support pole 22 is rigidly secured by cementing and/or a locking screw 23*a* to a centrally located tubular projection part 23 of a wave-guide shaped base plate 24. The tubular projection 23 protrudes into the lower hemisphere 1 but falls short of contacting the inner pole piece 7 of the magnetic arrangement B. The tubular projection 23 has an internal diameter which matches and mates with the diameter of the support pole 22, as well as the internal diameter of a second spider suspension 13 attached thereon by a bonding agent. The external diametrical edge of the lower spider suspension 13 is attached to the lower open end edge of the diaphragm C by a bonding agent. The lower spider suspension 13 has some clearance from the base plate 24 which is reinforced by flanges 25 connecting it to the lower edge of the tubular part 23. However, owing to the reduced weight of the magnetic arrangement B because of its relatively small size, the reinforcing flanges 25 can be eliminated. Once again, aluminum or steel alloys can be used for the base plate 24. The operating principle remains the same as the configuration as depicted in FIG. 1, but the wiring is much simpler. Internal conductors (not shown) are passed through the lower diaphragm half 1 and connected to external conductors 42 which are, in turn, connected to terminals 43. The terminals 43 are secured atop non-conducting, circular plates 44 and 45 which is held to the base plate 24 by means of rivets 46. Screw holes 47 are used to mount the transducer atop a planar surface. In reference to FIG. 3, the lower magnetic carrier 15 has an edge flange 18 with air openings 20 and weight reduction openings 17. The edge 18*a* is the edge onto which the internal edge flange 33 of the flexible surround 32 is attached. The area designated 21 is an aerial cross-section of the connecting rod of the support pole 22 as shown in FIG. 1.

Figure 4:
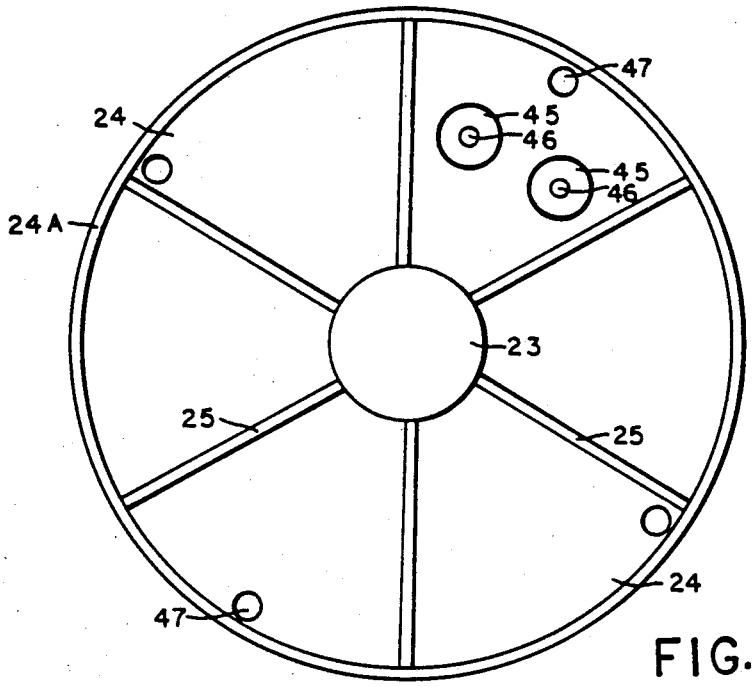
FIG. 4 is a sectional view of the present invention taken along line III—III of FIG. 2.

Referring now to FIG. 4, the base plate 24 is shown with the centrally located tubular projection 23. The base plate 24 has an edge flange 24*a* connected to the base of the central tubular projection 23 by lateral flanges 25. Mounting holes 47 are provided in the base plate 24 for mounting the present invention to any planar surface. 45 designates the non-conducting plates while 46 indicates the location of the rivets.

Figure 5:
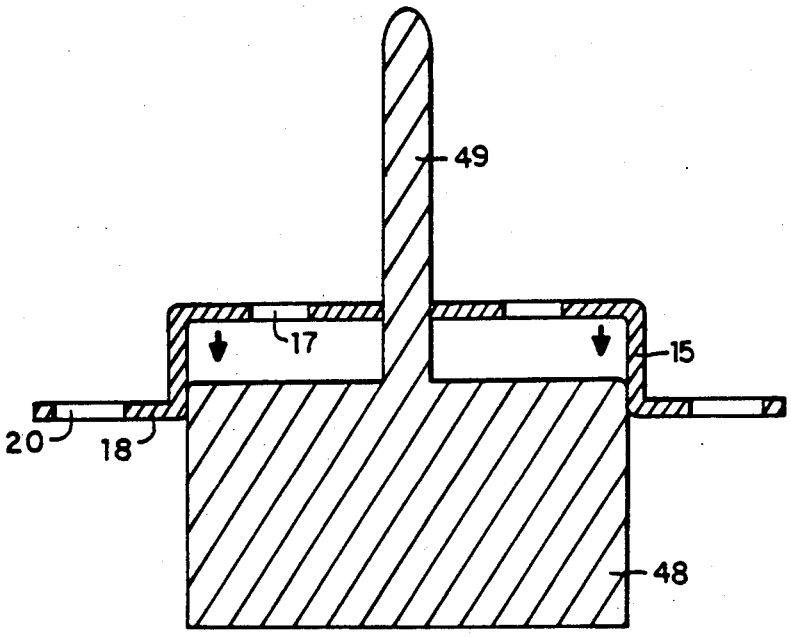
FIG. 5 is a representative first step in the manufacturing process of the present invention as shown in FIG. 1.

FIG. 5 depicts the assembling block 48 which has a centrally located positioning pin 49 in place. The magnetic carrier part 15 is lowered atop the assembling block 48, and the pin 49 passes through a central hole in the magnetic carrier part 15. The carrier part 15 contains holes 17 to reduce the overall weight of the carrier part 15. The edge flange 18 contains air passage openings 20.

Figure 6:
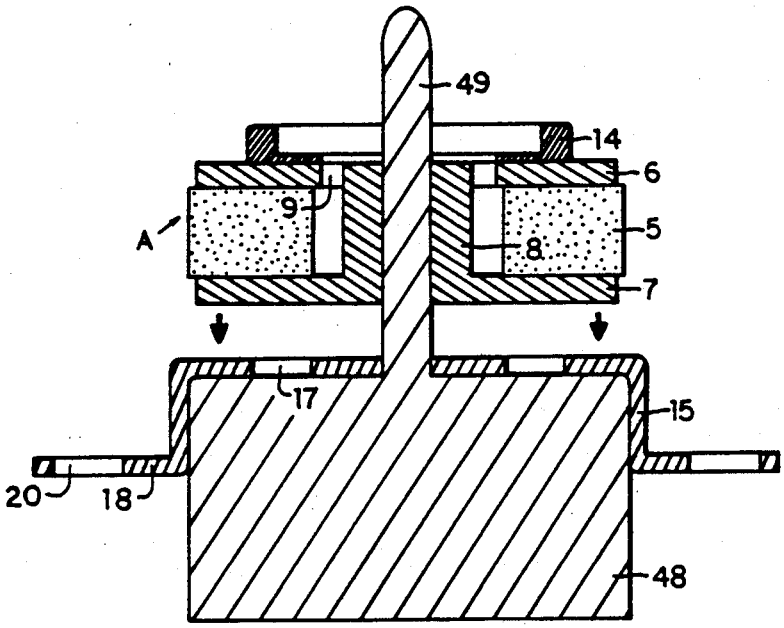
FIG. 6 is a representative second step in the manufacturing process of the present invention of FIG. 1.

FIG. 6 depicts the carrier part 15 firmly affixed atop the assembling block 48. The bonding agent to affix the carrier part 15 in place is applied at the top of the carrier part 15. The magnetic arrangement A is then lowered in place atop the carrier part 15 by sliding stub 8 of the inner pole piece 7 through the positioning pin 49. A centrally located hole is provided on stub 8 to aid in this part of the assembly. As shown in the diagram, the spider post 14 has been attached by bonding to the outer pole piece 6 before positioning the magnet circuit A.

This illustration shows the relationship between the magnet 5 and the air gap 9.

Figure 7:
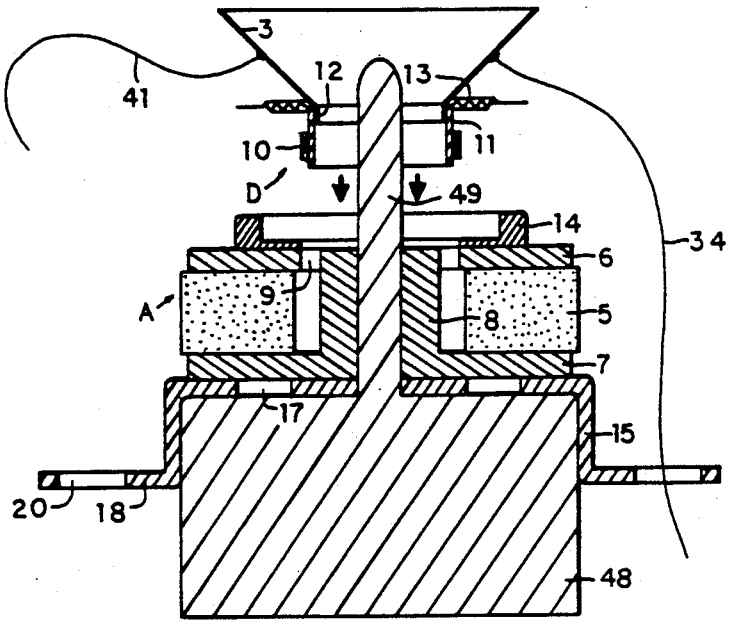
FIG. 7 represents a pictorial representation of the third step in the manufacturing of the present invention as illustrated in FIG. 1.

FIG. 7 shows the magnetic circuit A securely bonded to the carrier part 15. The bonding agent is applied to the upper edge surface of the post 14. The actuation assembly D is then lowered into place. The drive cone 3 contains a neck 3a onto which the bobbin 11 and the inner open edge of the spider suspension 13 are attached by a bonding agent. Conductors 34 and 41 are connected to voice coil 10 which has been wound on bobbin 11 in a preferably helical pattern.

Figure 8:
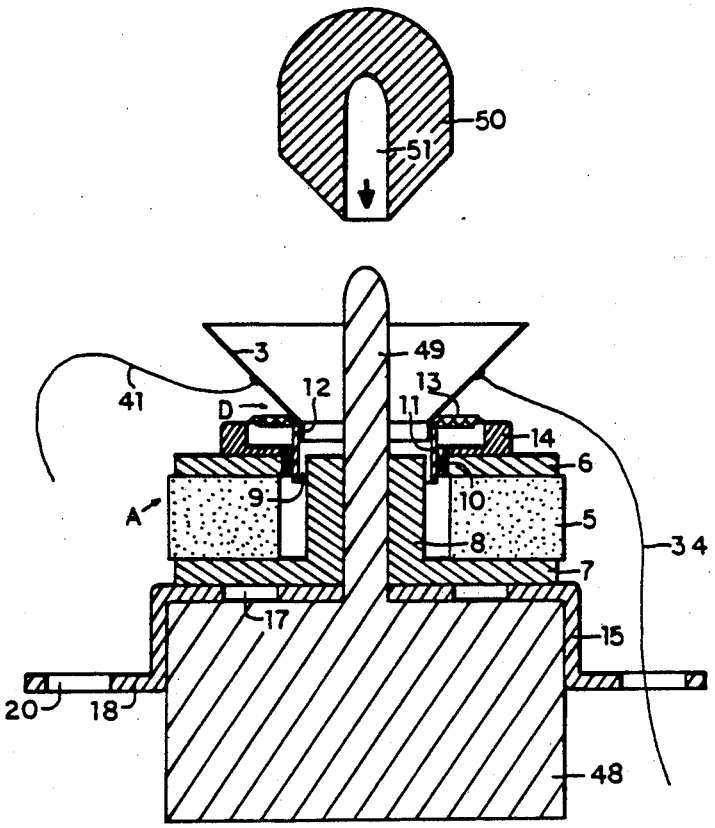
FIG. 8 is an illustration showing the fourth step in the manufacturing process of the electro-acoustic transducer of the present invention as illustrated in FIG. 1.

FIG. 8 shows the actuation assembly D as it would appear once lowered into position. The external edge of the spider assembly 13 is securely bonded to the annular post 14 thereby centering the voice coil 10 within the annular air gap 9. In order to test the voice coil 10 within the air gap 9, a dry cell of predetermined polarity is needed. When the current is applied by the dry cell, the coil 10 together with the actuating assembly D should move toward the air gap 9. The bonding agent is applied to the upper open edge of the drive cone 3. The alignment cap 50 has a centrally located opening 51. In this figure, the alignment cap 50 is being lowered atop the positioning pin 49 of the assembly block 48.

Figure 9:
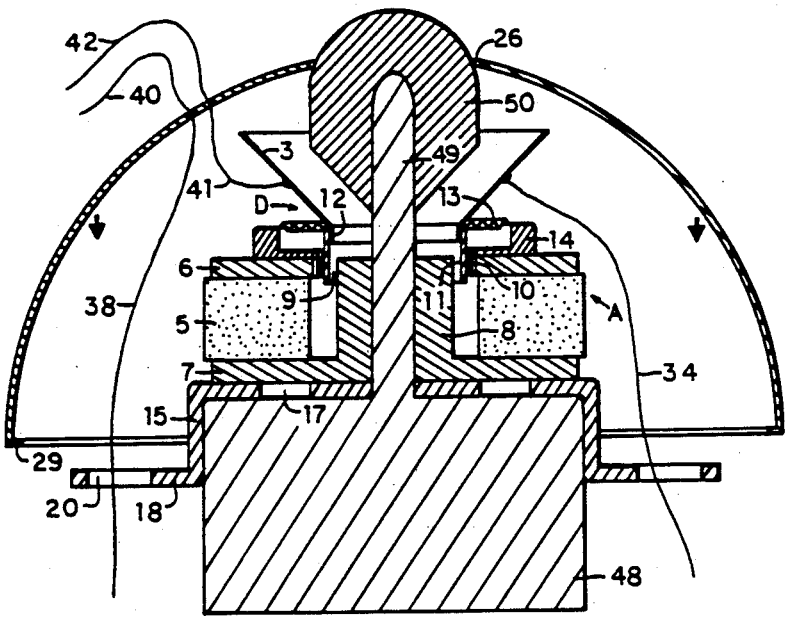
FIG. 9 corresponds to the fifth step in the manufacturing process of the present invention as illustrated in FIG. 1.

FIG. 9 depicts the alignment cap 50 positioned atop the positioning pin 49 of the assembly block 48 so that the upper section of the positioning pin 49 fits into the central hole 51 of the alignment cap 50. The conductors 38 and 41 are passed through the pre-punctured holes on the diaphragm member 1 which is lowered into place. The conductors 34 and 38 are passed through the air holes 20 of the carrier 15. The diaphragm 1 contains a flange 29 at its lower open end edge and an opening 26 at the apex region.

Figure 10:
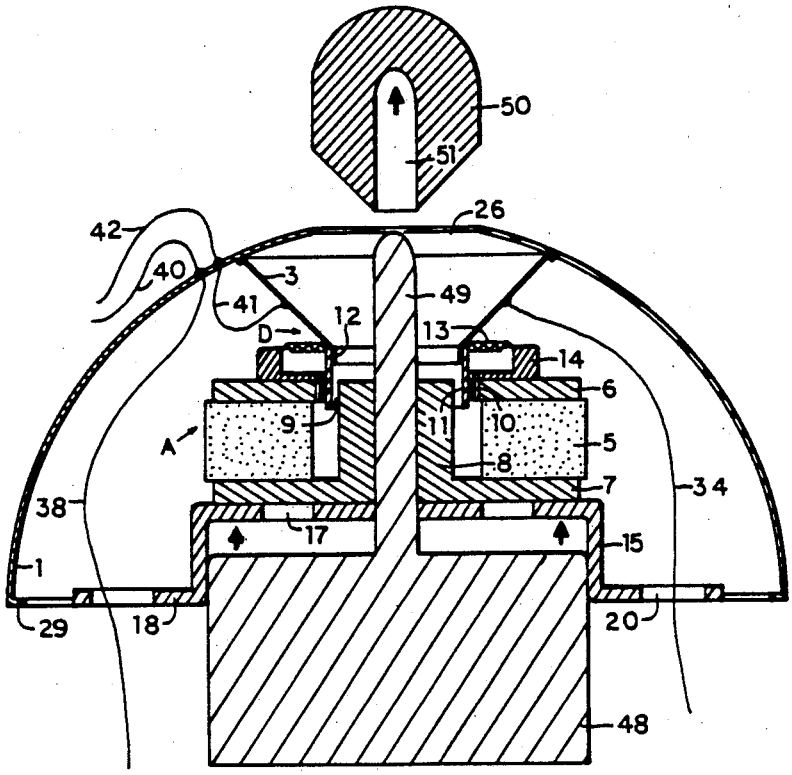
FIG. 10 represents the sixth step in the manufacturing process of the transducer of the present invention as illustrated in FIG. 1.

FIG. 10 shows the diaphragm segment 1 firmly and accurately bonded to the drive cone 3 with the aid of the alignment cap 50. The external diameter of the alignment cap 50 is practically equal to that of the opening 26 on the apex of the diaphragm member 1. The cap 50 is withdrawn and the now assembled half of the transducer is shown being removed from the assembling block 48. To remove the assembled section from the assembling block 48, one simply grasps the edge flange 18 of the carrier part 15 via the air holes 20. The assembly is gently removed by sliding the assemblage off of the positioning pin 49.

Figure 11:
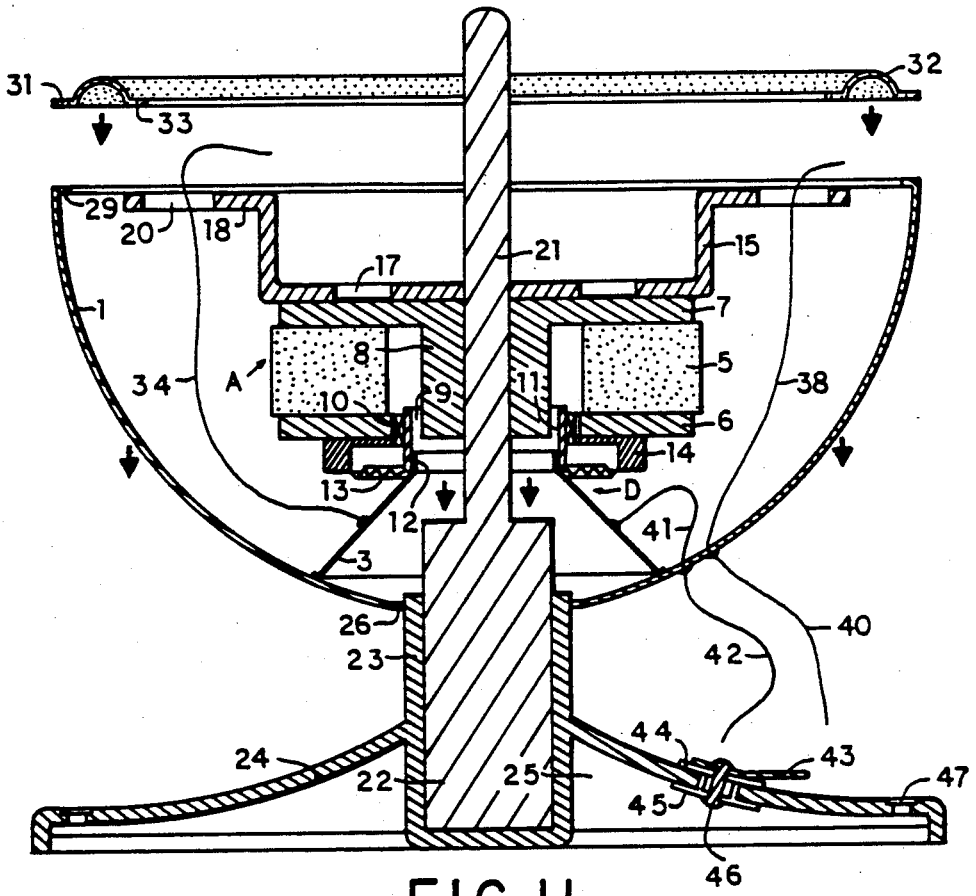
FIG. 11 is an illustration showing the seventh step in the process of making the electro-acoustic transducer of the present invention as illustrated in FIG. 1. The combination of FIG. 5 to 11 depict the process of manufacture for the lower half of the present invention. The remaining steps are not diagrammatically depicted as they are similar to the steps laid out in FIG. 5 to FIG. 11.

FIG. 11 depicts the support pole bonded to the tubular projection 23 of the base plate 24. The bonding agent is applied to the lower section of the connecting rod 21 as well as to the upper edge of the support pole 22. The now assembled half of the transducer is inverted and lowered atop the support pole 22 by using the central hole on the stub 8 as a guide through the connecting rod 21. The bonding agent is applied to both the edge of the flange 18 of the carrier part 15 and the peripheral edge flange 29 of the hemisphere 1. With the completion of this step, the flexible surround 32 may be lowered into place as shown. The flexible surround 32 is attached to both the flange 29 of the hemisphere 1 and to the flange 18 of the carrier part 15 by means of the flanges 31 and 33 of the surround 32. The external conductors 40 and 42 are coupled to the terminals 43. This step renders the lower operating half of the transducer complete.

To assemble the upper half of the transducer, the bonding agent is applied to the underside of the edge flange 19 of the carrier part 16. The steps shown in FIG. 5 through FIG. 10 are then repeated in substantially the same sequence.

The upper carrier part 16 is lowered into position with the aid of the connecting rod 21 such that the edges of the flanges 18 and 19 of the respective carrier parts 15 and 16 are firmly bonded together. The bonding agent is then applied to the top of the carrier part 16, and the upper magnetic arrangement B is lowered into place. The upper magnetic arrangement B is lowered into place with the aid of stub 8 which has been placed through the connecting rod 21 such that the inner pole piece 7 firmly bonds to the carrier part 16. The bonding agent is applied to the upper edge surface of the post 14. The actuation assembly E is then lowered into place such that the outer edge of the spider suspension 13 is securely attached to the post 14, thereby correctly locating the voice coil 10 within the air gap 9. With the upper actuation assembly E in place, the voice coil 10 is tested using a dry cell to insure that the actuation assembly E moves away from the air gap 9. With the electrical test completed, the lower internal conductors 34 and 38 are joined to the upper internal conductors 35 and 37 at points 36 and 39. With the wiring of the transducer completed, the bonding agent is applied to the upper edge of the drive cone 4 as well as to the outer surface of the peripheral edge flange 30 of the upper diaphragm hemisphere 2. With the dust cap 28 pre-attached to the hemisphere 2 by a bonding agent, the assembly is lowered into position such that the peripheral edge flange 30 is firmly conjugated to the outer edge flange 31 of the flexible surround 32. As a result, the two hemispherical portions 1 and 2 are accurately aligned at the equatorial diameter to produce a spherical shape. At the same time, the drive cone 4 is effectively conjugated to the apex region of the upper hemisphere 2. Thus, the manufacturing process of the transducer as depicted in FIG. 1 is completed.

The process of manufacture for the modified electroacoustic transducer shown in FIG. 2 is nearly identical to that of the FIG. 1 embodiment. However, the second embodiment is much simpler. The support pole 22 is pre-bonded to the tubular projection 23 of the base plate 24. The spider suspension 13 of the lower hemisphere 1 is pre-attached by a bonding agent. The support pole 22 with the tubular projection 23 attached is lowered atop the upper edge of the base plate 24. Next, the internal conductors 42, pre-connected to the internal conductors (not shown), are hooked up to the terminals 43. The bonding agent is applied to the connecting rod 21 as well as to the upper edge of the support pole 22. The magnetic arrangement B is then lowered atop the support pole 22 so that the connecting rod 21 fits into the central hole on the stub 8, and the parts are effectively bonded together. The bonding agent is then applied to the upper edge of the post 14. With this step completed, the actuation assembly E is lowered into position such that the upper suspension 13 attaches to the post 14 thereby correctly aligning the voice coil 10 within the air gap 9.

Using the internal conductors from the voice coil 10 (not shown) and a dry cell battery with predetermined polarity, the actuation assembly E is tested to insure that movement is away from the air gap 9. When the electrical test is completed, the internal conductors (not shown) are connected. The bonding agent is applied to the undersurface of the flange 30 of the upper hemisphere 2 having a pre-attached dust cap 28. The upper hemisphere 2 is then lowered and connected to the lower hemisphere 1 via the peripheral edge flange 29 and 30 and the drive cone 4. This diaphragm attachment technique results in a better alignment than other processes. The bonding agent is used to bond the inner diametrical edge of the lower suspension 13 to the tubular projection 23. This completes the assembly process of the modified transducer as depicted in FIG. 2.

It should be noted that despite the fact that the air flows around the spherical diaphragm C to achieve reasonable omnidirectionality, the dynamic pressure in a north-south direction is greater than in the equatorial east-west direction due to the greater compression along that axis. The shape of the base plate 24 helps channel air towards the east-west direction during the upward trend of the diaphragm C. Depending on the direction of the motion of the diaphragm C at a given point in time, the pressure zone directly confronting the apex region of each hemisphere 1 and 2 falls within the wake W. The polar openings on the diaphragm C enable air to reach and cool the coils 10 for increased power handling capability.

A dome shaped metal gauze (not shown) could be used to encapsulate the entire arrangement of parts in order to protect the diaphragm C. The gauze would extend from the edge of the base plate 24 and rise above the dust cap 28 with enough clearance to prevent contact with the diaphragm during maximum excursions. In such a design, the base plate 24 must have a diameter greater then the diameter of the diaphragm C at the equator.

The diagram of FIG. 12 has been explained previously. An individual skilled in the manufacture of electro-acoustic transducers can make changes to the design herein described without making changes to the scope and substance of the present invention.

It is to be understood that the present invention is not limited to the sole embodiment described above, but encompasses any and all embodiments within the scope of the following claims.

I claim:

1. An electro-acoustic transducer which can produce sound in substantially an omnidirectional capacity comprising:

a spherical diaphragm having two oppositely disposed openings;

said spherical diaphragm having upper and lower hemispherical portions, each said hemispherical portion having a peripheral edge flange extending inwardly around the periphery of said hemispherical portion at the equatorial diameter, said hemispherical portions connecting at the equatorial diameter by said inwardly extending peripheral edge flanges;

at least one drive cone disposed within and rigidly connected to said spherical diaphragm over at least one of said openings in said spherical diaphragm;

at least one actuation assembly including a voice coil disposed within said spherical diaphragm, each said at least one actuation assembly connected to each said at least one drive cone, each said actuation assembly also connected to a magnetic assembly, said magnetic assembly having a central gap within which said voice coil is disposed;

spider suspension means connecting each said drive cone to an outer pole piece attached to each said magnetic assembly;

a carrier assembly to which at least one magnetic assembly is attached, said carrier assembly having an outer carrier edge flange;

a resilient circular surround having an outer resilient surround edge flange disposed between and bonded to said inwardly extending peripheral edge flanges of said hemispherical portions, said resilient circular surround having an inner resilient surround edge flange attached to said carrier assembly edge flange;

a support pole disposed through said spherical diaphragm and at least one inner pole piece attached to each said magnetic assembly and supporting said spherical diaphragm, magnetic assembly and said carrier means;

a base plate assembly from which said support pole vertically extends, said base plate disposed beneath said spherical diaphragm and having a concave slope extending radially outward from said support pole, said base plate acting as a wave guide; whereby said voice coil, drive cone, magnetic assembly and said actuation assembly serve to drive said spherical diaphragm to produce sound in an omnidirectional manner.

2. An electro-acoustic transducer to produce sound in substantially an omnidirectional capacity according to claim 1 further comprising:

said spherical diaphragm being driven by two drive cones, said drive cones attaching to opposing polar regions of said spherical diaphragm, each of said drive cones attaching to one of two actuation assemblies, two magnetic assemblies located one to each of said hemispherical portions, said actuation assemblies attaching each to one of said magnetic assemblies, two voice coils, two carrier assemblies, said magnetic assemblies being connected by carrier assemblies wherein the upper of said magnetic assemblies being upright and the lower of said magnetic assemblies being inverted, said carrier assemblies having carrier edge flanges allowing for the connection of said carrier assemblies to one another, said carrier edge flange of the lower of said carrier assemblies extending adjacent the equatorial diameter of said spherical diaphragm, and said resilient surround having an inner resilient surround edge flange attached to said carrier edge flange of the lower of said carrier assemblies.

3. An electro-acoustic transducer to produce sound in substantially an omnidirectional capacity according to claim 1 further comprising:

said spherical diaphragm being driven to produce sound by one drive cone means, said drive cone attaching to said actuation assembly, said actuation assembly attaching to said magnetic assembly, said magnetic assembly housing said voice coil, said voice coil driving said actuation assembly, and said inner pole piece having at least one stub wherein said support pole extends through said stub.

4. An electro-acoustic transducer which can produce sound in substantially an omnidirectional capacity according to claim 1, wherein:

said resilient surround is located at the equatorial diameter of said hemispherical portions on the interior of said hemispherical portions.

5. An electro-acoustic transducer to produce sound in substantially omnidirectional capacity according to claim 2, wherein:

said magnetic assemblies are separated from one another allowing for the decrease in size of said drive cones and thereby the increase in the radiative sensitivity of said hemispherical portions.

6. A method of manufacture of an electro-acoustic transducer that can produce sound in substantially an omnidirectional capacity in the low to mid range frequencies comprising a spherical diaphragm means, said spherical diaphragm means dispersing sound generated therefrom in a substantially omnidirectional fashion, said spherical diaphragm means having two hemispherical portions, each of said hemispherical portions having a peripheral edge flange extending inwardly around the periphery of said hemispherical portion at the equatorial diameter, said hemispherical portions connecting at the equatorial diameter by said inwardly extending peripheral edge flanges creating said spherical diaphragm means, said spherical diaphragm means being driven to produce sound by two drive cone means, two actuation assemblies, said drive cone means attaching each to one of said actuation assemblies, two magnetic arrangements, said actuation assemblies attaching each to one of said magnetic arrangements, said drive cone means rigidly connecting to said spherical diaphragm means by a bonding means, at least one voice coil means per one of said actuation assemblies, said voice coil means driving said actuation assembly, said voice coil means being located within an air gap defined by said magnetic arrangement, at least one cup-shaped carrier means connected to each of said magnetic arrangements wherein the upper of said magnetic arrangements being upright and the lower of said magnetic arrangements being inverted, said cup-shaped carrier means having a carrier edge flange, said cup-shaped carrier means having carrier edge flanges allowing for the connection of said cup-shaped carrier means to one another, said carrier edge flange of the lower of said cup-shaped carrier means extending substantially to the equatorial diameter of said spherical diaphragm means, a flexible surround, said flexible surround having an outer flexible surround edge flange sandwiched between and bonded to said inwardly extending peripheral edge flanges of said hemispherical portions, said flexible surround having an inner flexible surround edge flange attached to said carrier edge flange, a support pole attaching to and supporting said magnetic arrangement and said spherical diaphragm means, at least one inner pole piece, said inner pole piece having at least one stub wherein said support pole extends through said stub, a base plate assembly, said support pole extending vertically from a base plate assembly, said base plate assembly having a wave guide shape enhancing the omnidirectional dispersion of sound generated by said spherical diaphragm means, a central tubular projection extending vertically from the center of said base plate, said central tubular projection defining a central cylindrical hole wherein said support pole may be placed and affixed by bonding means, said base plate having reinforcing flanges extending radially between the edge of said base plate and the lower most section of said tubular projection, said voice coil means associating with said magnetic arrangement in such a fashion wherein said voice coil means aid in the upwards vertical motion of said spherical diaphragm means, spider suspension means having two longitudinally disposed ends, said spider suspension means attaching to said drive cone means at one end and to said flexible surround at the other end wherein said spider suspension means functions to move said spherical diaphragm means in a downward vertical direction opposite that generated by said voice coil means, the lower of said hemispherical portions of said spherical diaphragm means having a hemisphere edge flange on said cup-shaped carrier means defining air openings allowing for the free movement of air within said spherical diaphragm means, and said spherical diaphragm means defining polar air openings at the polar regions allowing for the free movement of air within said drive cone means, comprising the following steps of:

lowering said cup-shaped carrier means atop an assembly block wherein the central pin of said assembly block passes through the center of said cup-shaped carrier means, applying a bonding agent to the top most region of said cup-shaped carrier means, lowering said magnetic arrangement over said pin of said assembly block wherein said magnetic arrangement sits atop said cup-shaped carrier means thereby bonding said magnetic arrangement to said cup-shaped carrier means, applying a bonding agent to the upper most surface of said magnetic arrangement, lowering said actuation assembly over said pin of said assembly block atop said magnetic arrangement thereby bonding said actuation assembly to said magnetic arrangement, lowering an alignment cap over said pin on said assembly block allowing for the alignment of said hemispherical portion and said actuation assembly as attached to said magnetic arrangement, bonding said hemispherical portion to said actuation assembly, removing said alignment cap from said pin, removing said hemispherical portion containing said actuation assembly, said magnetic arrangement, and said cup-shaped carrier means from said assembly block, assembling the second of said hemispherical portions in the same manner as the first, inverting the first of said hemispherical portions, bonding the two of said hemispherical portions together, mounting and bonding said spherical diaphragm to said tubular projection of said base plate assembly, positioning and bonding said cap over said polar openings, and bonding said hemispherical portions to one another by said peripheral edge flanges of said hemispherical portions.

7. A method of manufacture of an electro-acoustic transducer that can produce sound in substantially an omnidirectional capacity in the upper mid to high range frequencies comprising a spherical diaphragm means, said spherical diaphragm means dispersing sound generated therefrom in a substantially omnidirectional fashion, said spherical diaphragm means having two hemispherical portions, each of said hemispherical portions having a peripheral edge flange extending inwardly around the periphery of said hemispherical portion at the equatorial diameter, said hemispherical portions connecting at the equatorial diameter by said inwardly extending peripheral edge flanges creating said spherical diaphragm means, said spherical diaphragm means being driven to produce sound by one drive cone means, one actuation assembly, said drive cone means attaching to said actuation assembly, one magnetic arrangement, said actuation assembly attaching to said magnetic arrangement, said drive cone means rigidly connecting to said spherical diaphragm means by a bonding means, at least one voice coil means per one of said actuation assemblies, said voice coil means driving said actuation assembly, said voice coil means being located within an air gap defined by said magnetic arrangement, a flexible surround, said flexible surround having an outer flexible surround edge flange sandwiched between and bonded to said inwardly extending peripheral edge flanges of said hemispherical portions, said flexible surround having an inner flexible surround edge flange attached to said carrier edge flange, a support pole attaching to and supporting said magnetic arrangement and said spherical diaphragm means, at least one inner pole piece, said inner pole piece having at least one stub wherein said support pole extends through said stub, a base plate assembly, said support pole extending vertically from a base plate assembly, said base plate assembly having a wave guide shape enhancing the omnidirectional dispersion of sound generated by said spherical diaphragm means, a central tubular projection extending vertically from the center of said base plate, said central tubular projection defining a central cylindrical hole wherein said support pole may be placed and affixed by bonding means, said base plate having reinforcing flanges extending radially between the edge of said base plate and the lower most section of said tubular projection, said voice coil means associating with said magnetic arrangement in such a fashion wherein said voice coil means aid in the upwards vertical motion of said spherical diaphragm means, spider suspension means having two longitudinally disposed ends, said spider suspension means attaching to said drive cone means at one end and to said flexible surround at the other end wherein said spider suspension means functions to move said spherical diaphragm means in a downward vertical direction opposite that generated by said voice coil means, the lower of said hemispherical portions of said spherical diaphragm means having a hemisphere edge flange on said cup-shaped carrier means defining air openings allowing for the free movement of air within said spherical diaphragm means, and said spherical diaphragm means defining polar air openings at the polar regions allowing for the free movement of air within said drive cone means, comprising the following steps of:

lowering one of said hemispherical portions in an inverted position over said tubular projection of said base plate assembly, lowering said magnetic arrangement over and bonding said magnetic arrangement to said tubular projection of said base plate assembly, applying a bonding agent to the upper most surface of said magnetic arrangement, lowering said actuation assembly over said pin of said assembly block atop said magnetic arrangement thereby bonding said actuation assembly to said magnetic arrangement, bonding the upper of said hemispherical portion to said actuation assembly, bonding the two of said hemispherical portions to one another at said peripheral edge flange.

* * * * *